United States Patent [19]

TateBe et al.

[11] 4,391,231

[45] Jul. 5, 1983

[54] CYLINDER HEAD FOR AIR-COOLED ENGINES

[75] Inventors: Yoshikazu TateBe; Masafumi Egami; Toshimitsu Miyawaki, all of Nagoya, Japan

[73] Assignee: Mitsubishi Jukogyo Kabushiki Kaisha, Japan

[21] Appl. No.: 226,593

[22] Filed: Jan. 21, 1981

[30] Foreign Application Priority Data

Mar. 4, 1980 [JP] Japan ..... 55-27882[U]

[51] Int. Cl.[3] ..... F01P 1/02

[52] U.S. Cl. ..... 123/41.69

[58] Field of Search ..... 123/41.58, 41.69, 41.7, 123/41.56, 41.6

[56] References Cited

U.S. PATENT DOCUMENTS

| | | | |
|---|---|---|---|
| 3,598,092 | 8/1971 | Honda | 123/41.69 X |
| 3,650,250 | 3/1972 | Lohr et al. | 123/41.69 |
| 4,216,746 | 8/1980 | Freyn | 123/41.69 |

*Primary Examiner*—William A. Cuchlinski, Jr.
*Attorney, Agent, or Firm*—McGlew and Tuttle

[57] ABSTRACT

The present invention is to provide a cylinder head for air-cooled engines wherein a part of the top wall is depressed to form a rocker arm chamber and a cooling wind passage reaching the upper part of a suction port from the side of an exhaust port is formed between the bottom wall of the rocker arm chamber and the upper wall of a cylinder fitting surface, whereby the advantage of the performance of a conventional overhead valve engine is retained as it is, the defect of the increase of the height is kept as little as possible and the cooling performance is not reduced.

2 Claims, 6 Drawing Figures

CYLINDER HEAD FOR AIR-COOLED ENGINES

FIELD AND BACKGROUND OF THE INVENTION

The present invention relates to cylinder heads adapted to internal combustion engines and particularly small air-cooled engines and more particularly to a cylinder head for air-cooled engines characterized in that a part of the top wall of the cylinder head is depressed downward to form a rocker arm chamber and a cooling wind passage reaching the upper part of a suction port from the side of an exhaust port is formed between the bottom wall of said rocker arm chamber and the upper wall of a cylinder fitting surface.

FIG. 1 is a plan view of a typical example of a conventional generally used air-cooled side valve engine. This kind of generally used side valve engine is so wide in the use and so convenient to mount on a supporting frame and to handle that it is considered preferable to house and arrange an air cleaner a and muffler b of a carburetor between perpendicular planes A—A and B—B in the drawing. Therefore, a valve mechanism of such suction and exhaust systems as a suction port and exhaust port is fitted to a cylinder d so as to be in a direction substantially at right angles with the axial direction Y—Y of a crank shaft c.

Most of the current generally used air-cooled four-cycle engines are of such side valve type. However, such side valve engine has a defect that the engine performance is low. On the other hand, it is well known that a so-called overhead valve air-cooled engine having a valve mechanism of suction and exhaust systems at the top of a cylinder is higher in the engine performance than the above mentioned side valve engine.

However, the above mentioned overhead valve air-cooled engine has defects that the total height of the engine is higher than in the side valve air-cooled engine, therefore the engine mounting height is higher and the handling is difficult. These points shall be explained with reference to FIGS. 2 and 3 schematically showing a conventional overhead valve engine. A rocker arm chamber n housing a rocker arm and valve spring not illustrated is formed on the upper surface of the top of a cylinder head m, a combustion chamber g is formed below the rocker arm chamber n and a screw hole e for a spark plug is provided in the combustion chamber g. Further, an exhaust flange f is provided as illustrated by considering the arrangement of the above mentioned muffler b, carburetor and air-cleaner a. By the way, the engine exhaust has the flowing direction turned at right angles by an exhaust pipe not illustrated and is led to the muffler.

In the drawings, symbol h denotes a fin, i denotes a suction valve port, j denotes an exhaust valve port, k denotes a push rod hole and l denotes a suction flange.

In the air-cooled engine, a cooling wind is led to cool mostly the combustion chamber g, spark plug screw hole e and suction and exhaust valve ports i and j. However, in such case, the cooling wind will cool the screw hole e for the spark plug, will then hit the fin h, will turn the direction as shown by the arrow A in FIG. 2 and will cool the suction and exhaust valve ports i and j and combustion chamber g while passing through a through hole B within the cylinder head. In such case, the cooling wind will be obstructed by the suction port and exhaust port and therefore, if the cooling wind passage area is made large, there will be defects that the height of the cylinder head m will have to be made high and the total height of the engine will be high.

SUMMARY OF THE INVENTION

The present invention has as an object to provide a cylinder head wherein the advantage of the above mentioned conventional overhead valve engine where the engine performance is favorable is retained as it is, yet the defect of the increase of the height is kept as little as possible and the cooling performance is not reduced and is a cylinder head for air-cooled engines characterized in that a part of the top wall of the cylinder head is depressed downward to form a rocker arm chamber and a cooling wind passage reaching the upper part of a suction port from the side of an exhaust port is formed between the bottom wall of said rocker arm chamber and the upper wall of a cylinder fitting surface.

The present invention also provides a cylinder head for air-cooled engines wherein a cooling wind guide for guiding a cooling wind to the spark plug side is formed integrally with the cylinder head body on the side opposed to the push rods near the above mentioned exhaust port.

The present invention further provides a cylinder head for air-cooled engines wherein the above mentioned cooling wind guide is a loosely bent L-shaped cooling wind guide having a first plate surface substantially parallel with the flow of the cooling wind and a second plate surface bent downward at a fixed angle from said first plate surface.

BRIEF DESCRIPTION OF THE DRAWINGS

An embodiment of the present invention shall be described in the following with reference to the accompanying drawings in which:

FIG. 2 is a plan view;

FIG. 3 is a view seen in the direction of the arrow L in FIG. 2;

FIG. 4 is a plan view;

FIG. 5 is a side view seen in the direction of the arrow W in FIG. 4; and FIG. 6 is a sectioned view on line VI—VI in FIG. 5.

DESCRIPTION OF THE PREFERRED EMBODIMENT

Figure 4:
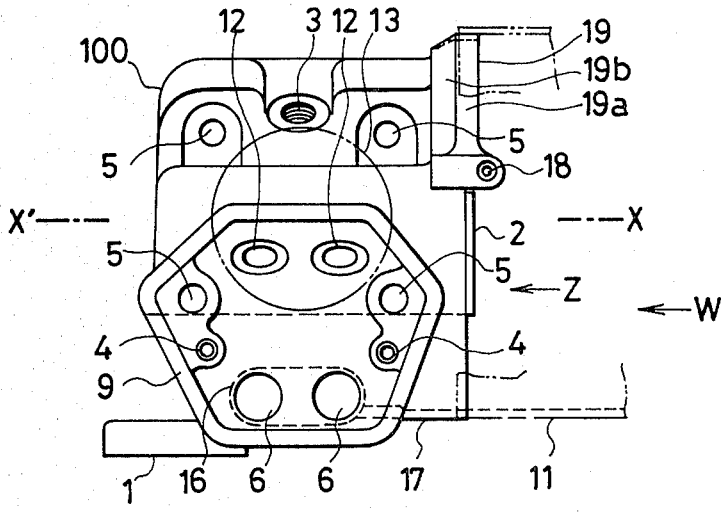
FIGS. 4 to 6 are schematic explanatory views of an embodiment of the present invention.
Figure 5:
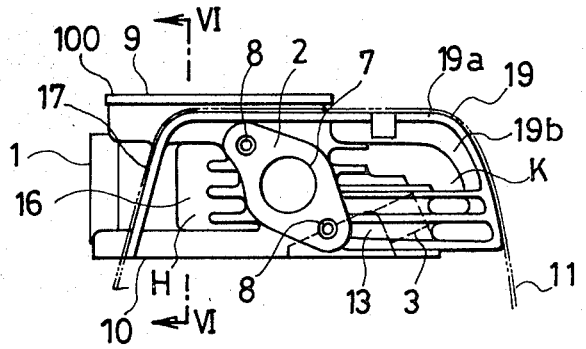
Figure 6:
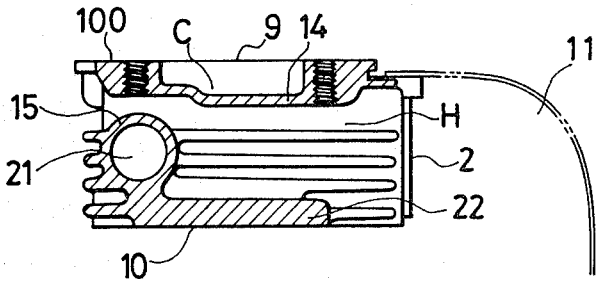

In FIGS. 4 to 6, reference numeral 1 denotes a suction flange, 2 denotes an exhaust flange, 3 denotes a screw hole for a spark plug, 4 denotes a rocker shaft fitting screw hole (two provided), 5 denotes a cylinder fitting bolt hole provided in each of four places as illustrated, 6 denotes a push rod hole (two provided), 7 (in FIG. 5) denotes an exhaust port, 8 denotes an exhaust pipe fitting screw hole (two provided), 9 denotes a top wall of a cylinder head forming a cylinder head cover (not illustrated) fitting surface, 10 denotes a cylinder fitting surface, 11 denotes a cowling guide, 12 denotes each of suction and exhaust valve ports, 13 denotes a combustion chamber, 14 denotes a bottom wall of a rocker arm chamber, 15 denotes a peripheral wall of a suction port 21, 16 denotes a peripheral wall of a push rod hole, 17 denotes a fin and 18 denotes a cowling guide fitting screw hole. These members are arranged in such relations as are illustrated to form a cylinder head.

In the present invention, a proper part of the top wall 9 of the above mentioned cylinder head is depressed downward by a proper depth as shown in FIG. 6 to form a rocker arm chamber C and a cooling wind passage H reaching the upper part of the suction port 21 from the side of the exhaust port 7 is formed between the bottom wall 14 of said rocker arm chamber C and the upper wall 22 of the cylinder fitting surface 10. Further, a cooling wind guide 19 is provided as cast integrally with a cylinder head body 100 on the cooling wind inlet side (on the right side in FIG. 4) opposed to the push rod holes 6 and is formed to be loosely bent L-shaped in the cross-section of a first plate surface 19*a* substantially parallel with the cooling wind flowing direction Z and a second plate surface 19*b* formed as bent downward at a fixed angle from said first plate surface 19*a*. In the drawing, symbol K denotes a cooling wind passage on the side opposed to the push rods.

By such formation, the height of the cylinder head is made much lower than in the conventional one.

Figure 1:
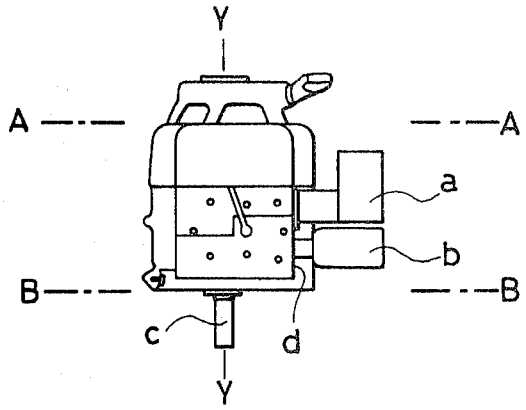
FIG. 1 (PRIOR ART)
FIG. 1 is a plan view of a conventional side valve air-cooled engine.
Figure 2:
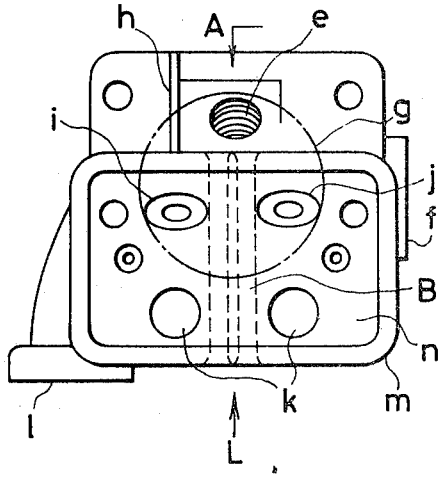
FIG. 2 (PRIOR ART)
FIGS. 2 and 3 are schematic explanatory views of a conventional overhead valve air-cooled engine.
Figure 3:
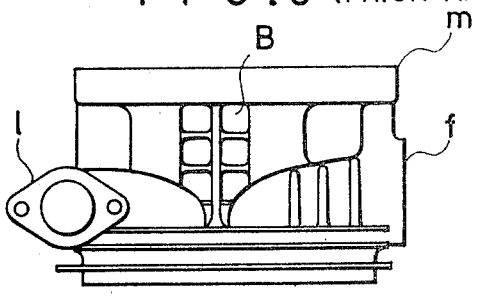
FIG. 3 (PRIOR ART)

By the way, the carburetor, air cleaner and muffler are arranged in positions adapted to mount the engine as explained in the conventional example in FIG. 1.

The cylinder head of the present invention is formed as mentioned above. Now, when the air-cooled engine equipped with the present cylinder head 100 is started, a gaseous mixture introduced into the combustion chamber 13 through the air cleaner and carburetor not illustrated and the suction port 21, will burn within said combustion chamber 13 and will be exhausted as an exhaust gas out of the combustion chamber 13. In such case, the exhaust gas will flow as turned to be in a direction substantially at right angles with the direction X—X' (the axial direction of the crank shaft) in FIG. 4 by an exhaust pipe not illustrated. In such case, the cooling wind will flow in the direction X→X' as indicated by the arrow Z in FIG. 4 and a part of it will be guided by the cooling wind guide 19 or particularly the loosely bent L-shaped part 19*b* to cool the combustion chamber 13 while cooling a spark plug not illustrated. Another part of the cooling wind will pass through the cooling wind passage H between the bottom wall 14 of the rocker arm chamber between the fin 17 and exhaust flange 2 and the upper wall of the cylinder fitting surface 10 to cool such high temperature part as the combustion chamber 13. In such case, in the present invention, as the downward depressed rocker arm chamber C is formed on the cylinder head cover fitting surface of the top wall 9 and the rocker arm and such member accompanying it as the valve spring are housed within said rocker arm chamber, the height of the cylinder head can be reduced to be much lower than in the conventional one. Also, the cooling wind passage H communicating with the upper part of the suction port 21 from the side of the exhaust port 7 is formed between the bottom wall 14 of said rocker arm chamber C and the upper wall of the cylinder fitting surface 10 so as to cool the members required to be cooled within the cylinder head with the cooling wind flowing through said passage H. Therefore, not only a sufficient cooling performance can be developed but also, in this respect, the height of the cylinder head can be reduced to be lower than in the conventional one.

Further, as the cooling wind guide 19 is provided as cast integrally with the cylinder head body 100, is connected with the cowling guide 11 and is loosely bent L-shaped so as to turn the cooling wind to be in the required direction, the cooling wind in the cooling wind passage K on the side opposed to the push rods will be prevented from blowing through and the required part will be able to be effectively cooled. Further, the conventional working of the cowling guide 11 and setting the cooling wind guide separately from the cylinder head body as measures of preventing wind from blowing through will become unnecessary, the cost of manufacturing the engine will be reduced and the structure will be smart in appearance.

Further, as the cooling wind guide 19 is cast integrally with the cylinder head body, the rigidity of the fin part will increase to be effective to reduce noise.

As the cylinder head of the present invention is formed as mentioned above, according to the present invention, there can be obtained such practical effect that a cylinder head retaining the advantage of the cylinder head of the above mentioned conventional overhead valve air-cooled engine as it is, yet eliminating its defects, reducing the height and providing a high cooling capacity.

We claim:

1. A cylinder head with a head body for an overhead valve, air-cooled engine having a rocker arm chamber (c), a suction port (21) and an exhaust port (7), comprising a part of a top wall of the cylinder head being depressed downwardly to form said rocker arm chamber (c) and defining a top of a first cooling wind passage (H) which extends over an upper part (15) of said suction portion, said part of the top wall of the cylinder head extending from a side of said exhaust port (7), said first passage (H) formed between a bottom wall (14) of said rocker arm chamber (c) and an upper wall of a cylinder fitting surface (10) of said head, said suction port (21) extending from a top of said upper wall of said cylinder fitting surface, a fin (17) extending around said first passage on a side thereof opposite said exhaust port (7), and a cooling wind guide (19) for guiding a cooling wind to a spark plug side of head, formed integrally with said cylinder head body on a side thereof opposite said cooling first cooling wind passage (H) and near said exhaust port (7) to form a second cooling wind passage (K), said first and second passages passing on opposite sides of said exhaust port.

2. A cylinder head for air-cooled engines according to claim 1 wherein said cooling wind guide is a loosely bent L-shaped cooling wind guide having a first plate surface substantially parallel with the flow of the cooling wind and a second plate surface bent downwardly at a fixed angle from said first plate surface.

* * * * *